US008371519B2

(12) United States Patent
McManus et al.

(10) Patent No.: US 8,371,519 B2
(45) Date of Patent: Feb. 12, 2013

(54) STEM PACKING DISPENSER

(75) Inventors: Michael W. McManus, Marion, NY (US); Marc E. Semmler, Livonia, NY (US); Mari Foley, Canandaigua, NY (US); Matt Tones, Palmyra, NY (US); Christian Lauzier, Kingsey Falls (CA); Chris Boss, Macedon, NY (US); Janet C. Jessen, Penfield, NY (US); Timothy James Hurley, Penfield, NY (US); David W. Reeves, Orinda, CA (US)

(73) Assignee: Garlock Sealing Technologies LLC, Palmyra, NY (US)

( * ) Notice: Subject to any disclaimer, the term of this patent is extended or adjusted under 35 U.S.C. 154(b) by 304 days.

(21) Appl. No.: 12/759,514

(22) Filed: Apr. 13, 2010

(65) Prior Publication Data

US 2010/0320310 A1 Dec. 23, 2010

Related U.S. Application Data

(60) Provisional application No. 61/170,453, filed on Apr. 17, 2009.

(51) Int. Cl.

| | |
|---|---|
| ***B65H 49/20*** | (2006.01) |
| ***B65H 75/18*** | (2006.01) |
| ***B65D 85/04*** | (2006.01) |
| ***B65D 5/72*** | (2006.01) |

(52) U.S. Cl. ..... 242/588.6; 242/594.3; 242/598.3; 242/598.6; 242/563; 242/912; 242/129.6

(58) Field of Classification Search ..... 242/170, 242/171, 588, 588.2, 588.3, 588.4, 588.6, 242/594, 594.3, 598, 598.3, 598.5, 598.6, 242/129, 129.6, 563, 912

See application file for complete search history.

(56) References Cited

U.S. PATENT DOCUMENTS

| | | | | |
|---|---|---|---|---|
| 2,841,343 | A * | 7/1958 | Dorman | 242/571 |
| 4,256,317 | A | 3/1981 | Havens et al. | |
| 4,281,840 | A | 8/1981 | Harris | |
| 4,327,923 | A | 5/1982 | Chesterton et al. | |
| 4,328,974 | A | 5/1982 | White et al. | |
| 4,560,176 | A | 12/1985 | Hoff | |
| 4,826,181 | A | 5/1989 | Howard | |
| 5,201,532 | A | 4/1993 | Salesky et al. | |
| 5,228,701 | A | 7/1993 | Greinke et al. | |
| 5,522,603 | A | 6/1996 | Naitou et al. | |

(Continued)

FOREIGN PATENT DOCUMENTS

| | | |
|---|---|---|
| CA | 1116200 | 11/2010 |
| GB | 2287772 A | 9/1995 |

OTHER PUBLICATIONS

International Search Report and Written Opinion mailed Oct. 20, 2010 for application No. PCT/US2010/030920, 8 pages.

*Primary Examiner* — William E Dondero
(74) *Attorney, Agent, or Firm* — Holland & Hart LLP

(57) ABSTRACT

A cord material dispenser comprising a container including a surrounding sidewall having first and second openings and first and second cord materials disposed in the container. The first and second cord materials are dispensable through their respective first and second openings. The first cord material is preferably wound around a first spool and the second cord material is preferably wound around a second spool. The dispenser may include a first quantity of the first cord material and a second quantity of the second cord material, wherein the first quantity is less than the second quantity. For example, the first quantity may be one fourth of the second quantity. Preferably, the container includes indicia indicative of the ratio of the first quantity to the second quantity. The indicia may be in the form of a graphic representative of the intended use of the spooled materials.

20 Claims, 9 Drawing Sheets

U.S. PATENT DOCUMENTS 5,803,464 A 9/1998 Ueda et al.
5,806,858 A 9/1998 Harrelson, III
5,938,145 A * 8/1999 Dueck ..... 242/559.4
6,056,235 A * 5/2000 Brozinsky ..... 242/598.6
6,105,596 A 8/2000 Hoyes et al.
6,193,095 B1 2/2001 McNeil
6,273,431 B1 8/2001 Webb
7,222,817 B2 * 5/2007 Stringer ..... 242/588.3
2003/0085080 A1 5/2003 Glassey

* cited by examiner

STEM PACKING DISPENSER

CROSS-REFERENCE TO RELATED APPLICATIONS

This application claims the benefit of U.S. Provisional Patent Application No. 61/170,453, filed Apr. 17, 2009, the disclosure of which is hereby incorporated by reference in its entirety

BACKGROUND

Valve stem packing is commonly used in process control valves. In the past, the criteria for selecting stem packing was simply to strike a balance between leakage and friction. Packing box leakage, although not desired, was not a significant concern for many process industries until valve consumers became cost conscious about material losses and recognized that valve stem packing leakage contributed to pollution. The EPA also recognized that stem packing leakage contributed to pollution and set standards for acceptable limits. Many of the largest consumers of process control valves also set their own standards for leakage and friction requirements.

This new interest in valve stem packing performance prompted the industry to develop low-friction packing systems that seal well and provide predictable performance. One development in stem packing is the use of different packing materials in combination, which provides resiliency along with high-pressure sealing capability, that remains consistent throughout the life of the valve packing. For example, Garlock Sealing Technologies markets an ultra-low emission valve stem packing product that uses a single ring of a first braided packing material that is soft and resilient interposed between four rings of a second braided packing material.

In order to realize the benefits of such technology, the correct types of packing material must be installed in the correct order and in the correct amounts. Typically, stem packing materials are provided on large spools and sold by the pound. Thus, consumers are left to determine how much of each type of packing material is required for their facility. Spools also may be difficult to store and may eventually come unraveled possibly resulting in damaged packing material or wasted packing material. Also, storing many different styles of packing material together may lead to confusion regarding which types of packing materials are to be used in combination. Furthermore, where the quantities of materials do not match in the ratio required, there may be a tendency to substitute one material for another leading to insufficient performance of the stem packing system.

Accordingly, there is a need for a stem packing dispenser that provides the correct ratio of materials for a given stem packing system. Furthermore, it is desirable that such a stem packing dispenser protects the packing from damage and provides a convenient means of transporting, storing, and reordering the product.

SUMMARY

Disclosed herein is a cord material dispenser, such as a stem packing dispenser. The dispenser comprises a container including a surrounding sidewall having first and second openings formed therethrough, a first cord material disposed in the container, and a second cord material disposed in the container. The first cord material is dispensable through the first opening and the second cord material is dispensable through the second opening. The first cord material is preferably wound around a first spool and the second cord material is preferably wound around a second spool.

The dispenser may include a first quantity of the first cord material and a second quantity of the second cord material wherein the first quantity is less than the second quantity. For example, the first quantity may be one fourth of the second quantity. Preferably the container includes indicia indicative of the ratio of the first quantity to the second quantity. The indicia may be in the form of a graphic representative of the intended use of the spooled materials.

The dispenser may include a spool support insert that includes at least one partition wherein each partition includes a slot. A spool axle extends through the first and second spools and the slot, thereby supporting the spools in the container.

The dispenser includes a first pull string attached to one end of the first cord material and a second pull string attached to one end of the second cord material. Each of the first and second pull strings extends through a respective one of the first and second openings.

Also contemplated is a valve stem packing set, comprising a container and first and second packing cord materials. The container includes a base portion, a surrounding sidewall extending from the base, and a plurality of flaps extend from the surrounding sidewall to form a closable lid for the container. The first packing cord is wound about a first spool and the second packing cord is wound about a second spool. The first packing cord is dispensable through the first opening and the second packing cord is dispensable through the second opening. The valve stem packing set may also include a pouch adhered to the exterior of the surrounding sidewall, the pouch containing a plurality of tags.

Also disclosed is a spooled material container assembly, comprising a container, a spool support insert, and a spool axle. The container comprises a base portion, a surrounding sidewall extending from the base portion, and a plurality of flaps extending from the surrounding sidewall, wherein the sidewall includes a plurality of frangible perforated star patterns formed therethrough. The spool support insert is disposed in the container and includes a plurality of partitions wherein each partition includes a slot. The spool axle extends through the slots of the insert and the spool axle is configured for supporting a plurality of spooled materials. The container may include indicia indicative of the spooled materials to be contained in the container.

DETAILED DESCRIPTION

The present invention relates generally to a dispenser for spooled materials, and particularly to a dispenser for dispensing valve stem packing material in amounts according to a predetermined ratio. The disclosed dispenser also protects the packing from damage and provides a convenient means of transporting, storing, and reordering stem packing materials. Moreover, the disclosed dispenser is described using recycled and recyclable cardboard products. While the recycled cardboard is desirable to make the dispenser "GREEN", the dispenser could be made from metal or plastic. Additionally, individual components may be made of different material; for example, the spool axle of FIG. 6 may be made of plastic instead of cardboard as shown.

Figure 1:
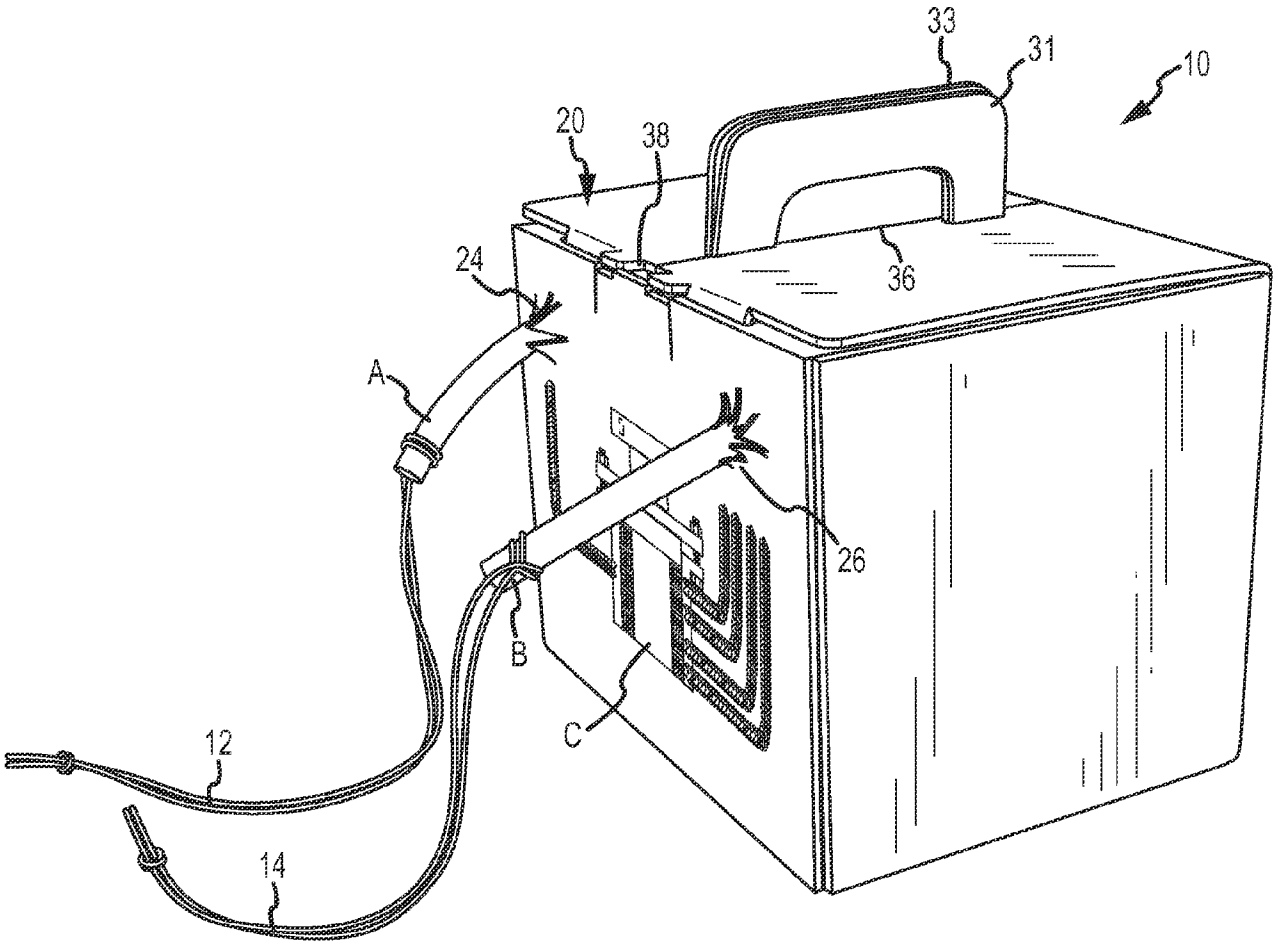
FIG. 1 is a perspective view illustrating an exemplary embodiment of a stem packing dispenser.

FIG. 1 shows an exemplary embodiment of a valve packing dispenser 10. Dispenser 10 includes container 20 which protects packing cord materials A and B. Notice, dispenser 10 may be reused when new materials A and B are provided or dispenser 10 may be disposable. Container 20 also includes handles 31 and 33 that provide a convenient means for transporting the packing set. Two handles 31 and 33 are a function of the cardboard box construction and dispenser 10 may be provided with one, two, or more handles. As shown in the figure, each packing cord A and B may be pulled through its respective opening 24 and 26.

Figure 2:
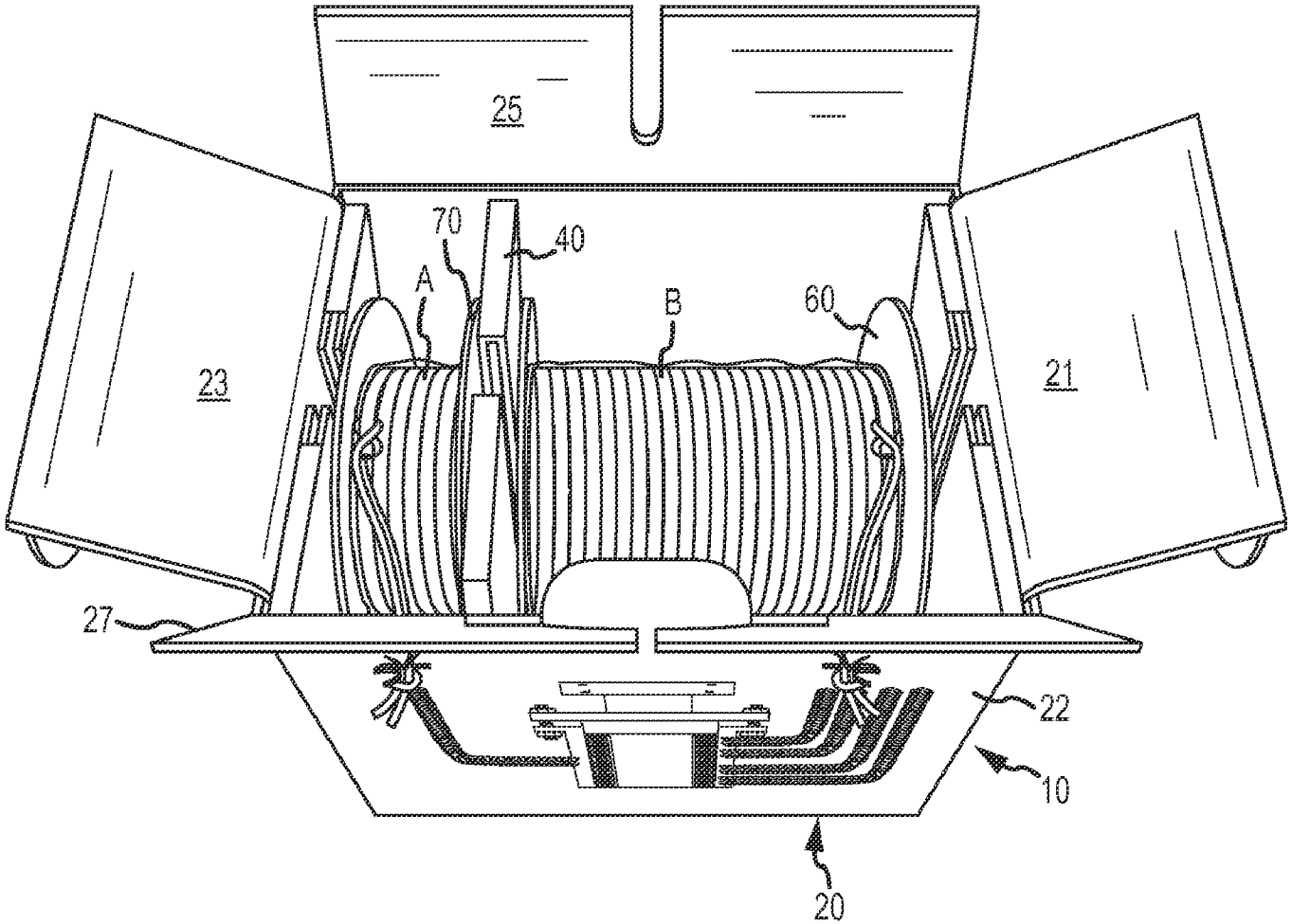
FIG. 2 is a perspective view of the dispenser shown in FIG. 1 with the lid flaps opened revealing the interior of the dispenser.
Figure 3:
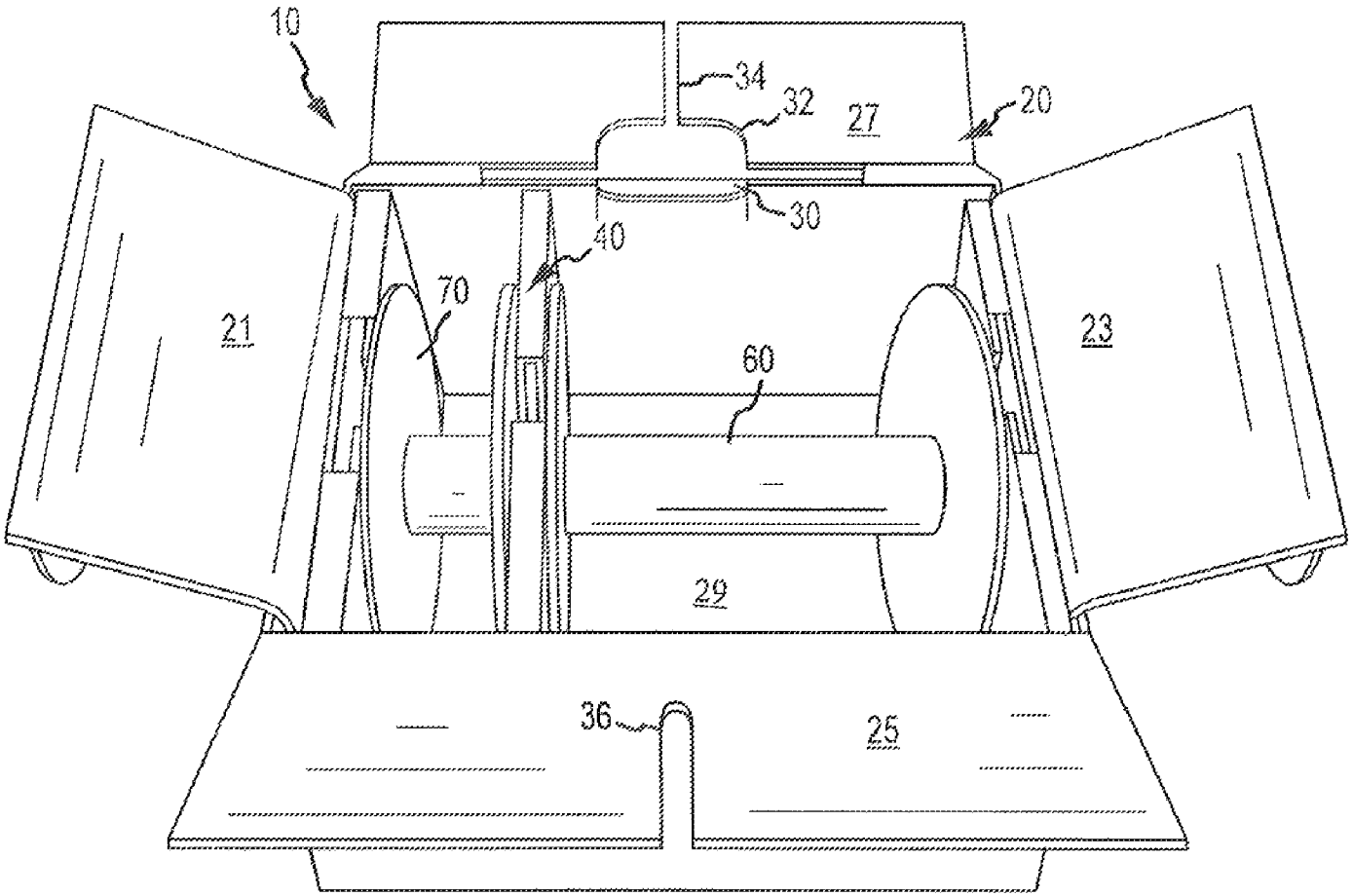
FIG. 3 is a perspective view similar to that of FIG. 2 without the stem packing material.

As can be seen with reference to FIG. 2, the interior of container 20 contains spool support insert 40 along with spools 60 and 70. Packing cord types A and B are wound around their respective spool. Container 20 includes a surrounding sidewall 22 which extends from a base 29 (as shown in FIG. 3). Extending from sidewall 22 are lid flaps 21, 23, 25, and 27. As can be appreciated with reference to FIG. 1, these flaps fold inwardly in order to enclose container 20. With reference to FIG. 3, it can be seen that tab 30 is sized and configured to engage slot 38 (see FIG. 1) formed in flap 25 and is thereby operative to secure the lid in the closed position. Flaps 25 and 27 each includes a slot, 34 and 36 respectively, formed therethrough, which when the flaps are closed, align with each other to form an opening. Openings 34, 36 receive handles 31 and 33 which are integrally formed with flaps 21 and 22.

With reference to FIG. 3, it can be appreciated that spools 60 and 70 are of different lengths. Thus, each spool has a capacity for carrying packing cord in proportion to the amount of packing cord required for a particular application. In this case, the packing cord is used in a ratio of four to one, as is indicated by the graphic C on the front of container 20. Accordingly, each valve stem to be packed uses four rings of type B material to every one ring of type A material. As a result, dispenser 10 provides a convenient means to ensure that each valve using the system is packed with the correct quantity of each type of packing cord. Alternative volumetric configurations are possible for different combinations. Also, dispenser 10 may be constructed to dispense a single material A, for example, in which case part 26 could be removed and the spool support insert could be configured for a single spool.

It should be noted that each spool is optionally wrapped with plastic to further protect the packing cord (see FIG. 2). Pull strings 12 and 14 may be attached to the free ends of materials A and B to facilitate the initial extraction of the packing cord through openings 24 and 26 without requiring the lid to be opened.

Figure 4:
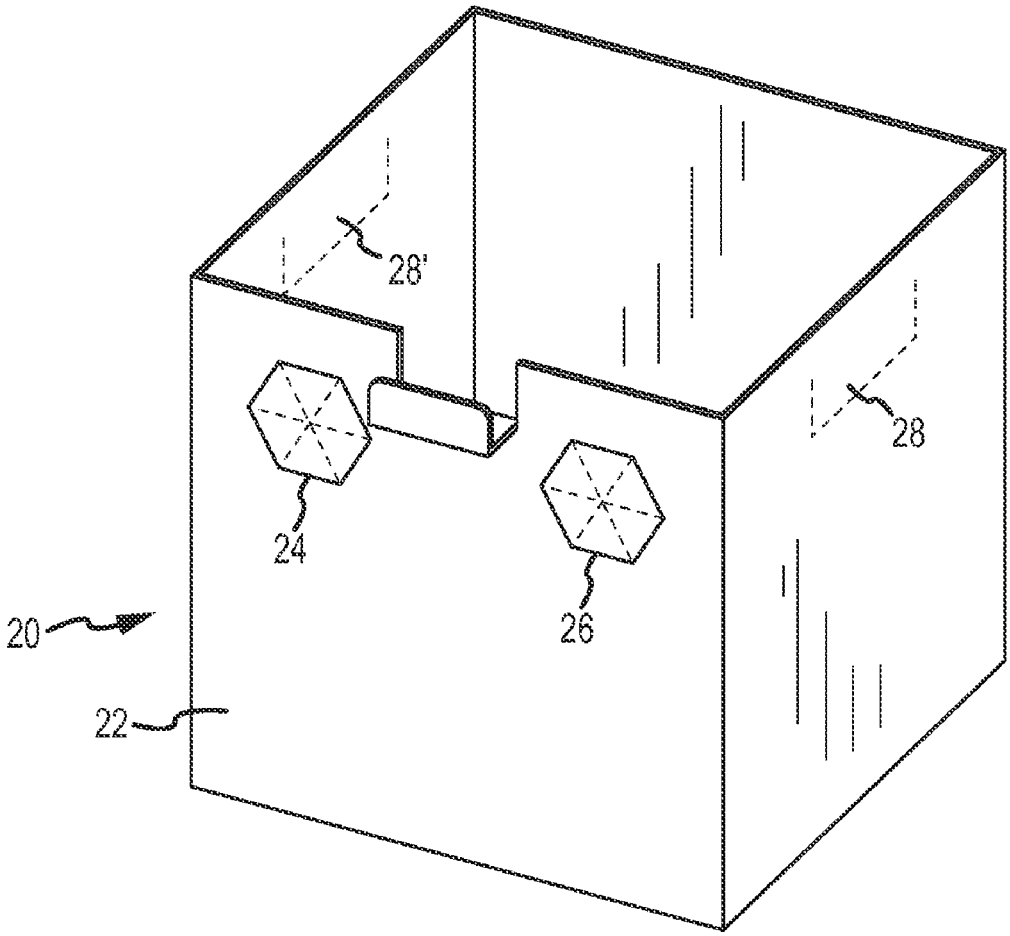
FIG. 4 is a perspective view of a dispenser's container with the lid flaps not shown for clarity.

As shown in FIG. 4, openings 24 and 26 are initially formed into sidewall 22 as a frangible perforated star pattern. During assembly of the valve stem packing set, pull strings 12 and 14 may be pushed through openings 24 and 26 from the inside of container 20. Alternatively, the cord material may be pushed through the perforations. While the perforations are shown here as a cross pattern in the form of the polygon, other perforation configurations may be suitable, such as a single flap, a punch out, various other perforation patterns, and the like. Also shown in FIG. 4 are optional handholds in the form of perforated flaps 28 and 28'.

Figure 5:
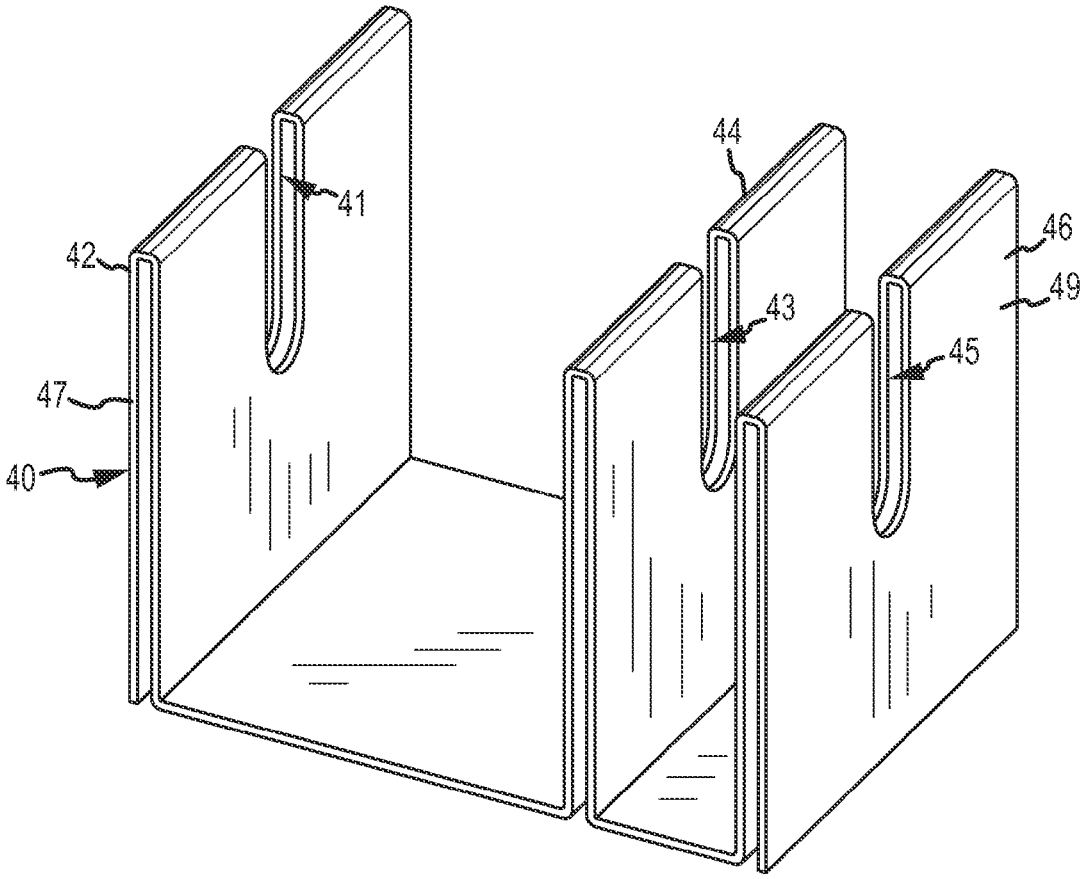
FIG. 5 is a perspective view of a spool support insert.

The construction of spool support insert 40 is perhaps best shown in FIG. 5. In this case, insert 40 is comprised of a single sheet of corrugate or cardboard which is folded to form partitions 42, 44, and 46. Each partition includes a slot formed therethrough which supports spools 60 and 70 on an axle 62 (see FIG. 6). Insert 40 is sized and configured to be congruent with the base of container 20 such that partitions 42, 44, and 46 fit in close-confronting relation within surrounding sidewall 22. While the exemplary embodiment shows two spools, it should be appreciated that more than two spools or a single spool may be used as appropriate depending on the number of different products to be dispensed for a given system configuration. Moreover, while partitions 42, 44, and 46 are shown as a single piece of cardboard, it should be appreciated that each partition 42, 44, and 46 may be a separate piece of cardboard. Moreover, in some embodiments, the partitions may be constructed by a non-folded piece of cardboard. For example, flaps 47 and 49 may be removed in certain embodiments.

Figure 6:
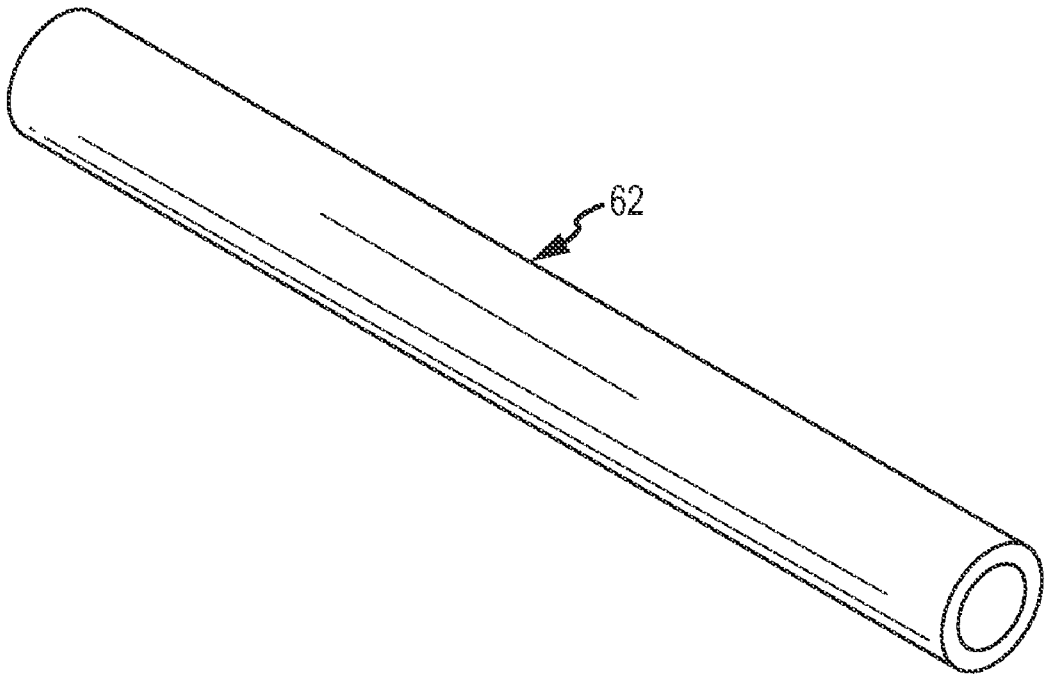
FIG. 6 is a perspective view of a spool axle.

FIG. 6 shows an axle 62 which may be used to support the spools in spool support insert 40. Axle 62 may be formed of cardboard or may be formed of a tubular plastic material. Other suitable materials may be used for the axle such as wooden dowel material, metal, or the like. Furthermore, axle 62 may be hollow, as shown, or may be solid.

It should be appreciated that while container 20, insert 40, and spools 60 and 70 are all shown in the figures as being formed from cardboard and other paper products, other materials may be suitable. For instance, plastic materials, wood fiberboard, metal, and the like may be preferred in some applications. Preferably, the materials used in the construction of the dispenser are recyclable.

Figure 7:
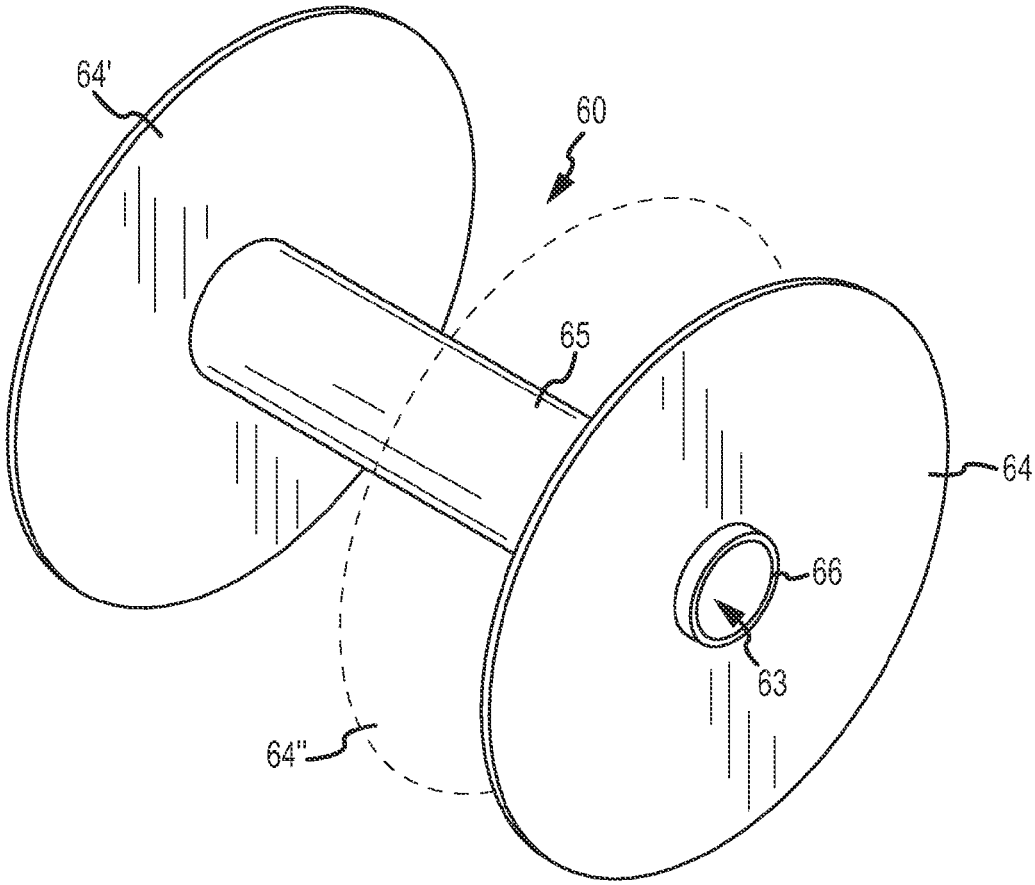
FIG. 7 is a perspective view of a long spool.
Figure 8:
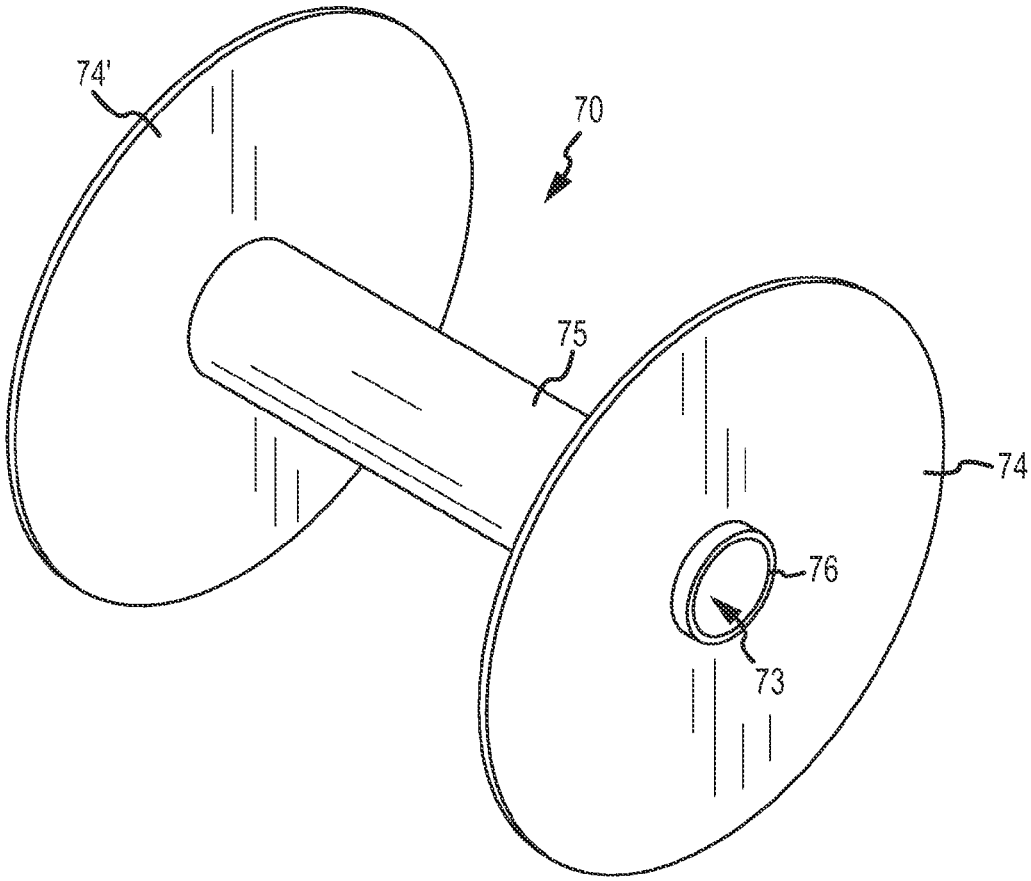
FIG. 8 is a perspective view of a short spool.

FIG. 7 illustrates a representative large spool 60, which comprises mandrel 65 with flanges 64 and 64' disposed on opposite end portions of the mandrel. Preferably, mandrel 65 extends beyond flanges 64 and 64' to provide collars 66. It should be appreciated that mandrel 65 is hollow with opening 63 that is sized to receive axle 62. Alternatively, mandrel 65 may operate as axle 62. As shown in FIG. 8, small spool 70 has a similar construction to large spool 60, yet with a shorter mandrel length. Also, while shown as two separate spools, spools 60 and 70 may be integrated into a single spool. In this case, for example, mandrel 65 may be provided with an intermediate flange 64", shown in phantom.

As shown and described, spools 60 and 70 rotate, as packing material is dispensed, out of dispenser 10. However, rotation of the spool is optional.

Figure 9:
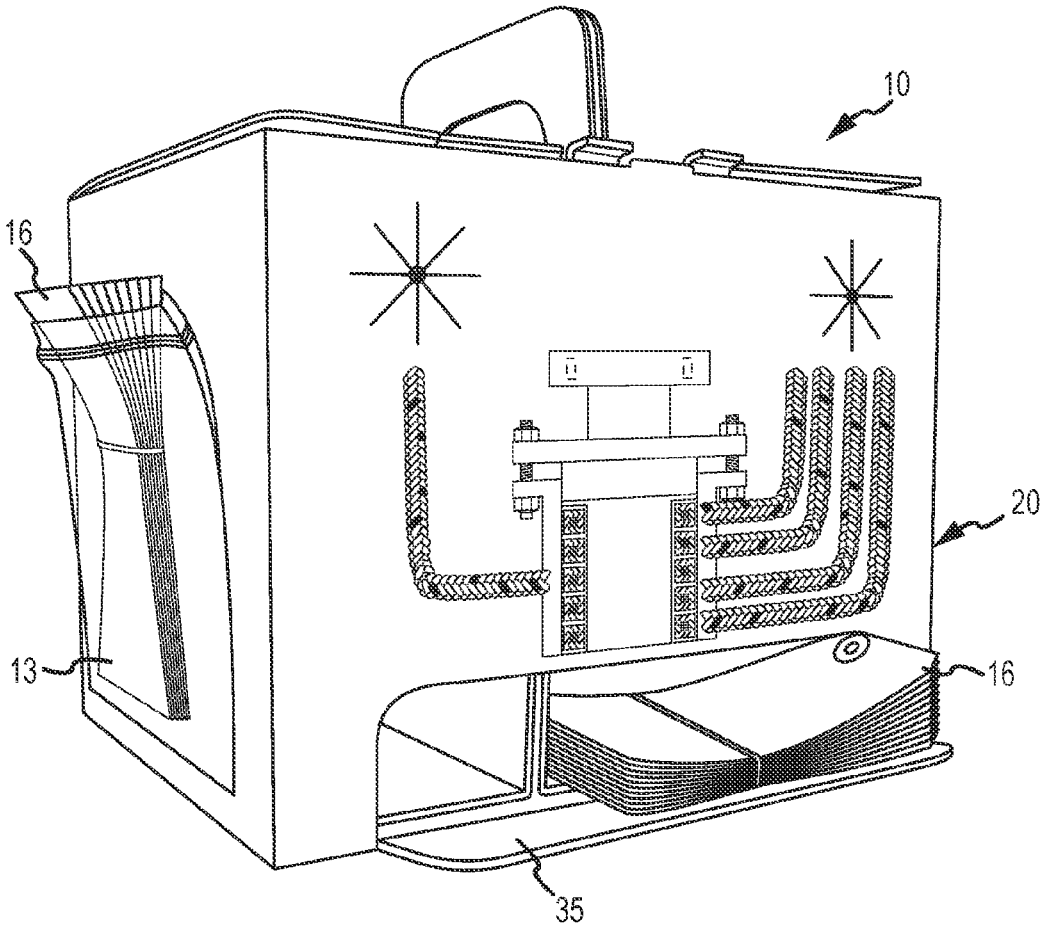
FIG. 9 is a perspective view of a valve stem packing dispenser illustrating optional tag storage locations.

As shown in FIG. 9, tags 16 may be included in the valve stem packing set. These tags may be used to indicate which valves in a facility have been updated with the new stem packing materials or as a reminder that follow-up procedures related to replacement of valve packing need to be performed. Tags 16 may be included in a transparent bag or pouch adhered to the side of container 20 or may be stored on the interior of container 20. When stored inside container 20, the tags may be accessed through a flap 35. Flap 35 could be formed through sidewall 22 with perforations, such as those described above, with respect to openings 24 and 26. Flap 35 may be reinforced and/or extended to provide a working surface, such as to allow writing on tags 16.

Accordingly, the present invention has been described with some degree of particularity directed to the exemplary embodiments. It should be appreciated, though, that the present invention is defined by the following claims construed in light of the prior art so that modifications or changes may be made to the exemplary embodiments without departing from the inventive concepts contained herein.

We claim:

1. A dispenser for dispensing first and second cord packing material, comprising:

a container including a surrounding sidewall having first and second openings formed therethrough;

a first quantity of a first cord packing material disposed in said container; and a second quantity of a second cord packing material disposed in said container;

wherein said first cord material is dispensable through said first opening and said second cord material is dispensable through said second opening, and wherein the first quantity and the second quantity equal a ratio of the first cord packing material to the second cord packing material needed to pack a valve stem.

2. A dispenser according to claim 1 including a first pull string attached to one end of said first cord packing material and a second pull string attached to one end of said second cord packing material, each said first and second pull string extending through a respective said first and second opening.

3. A dispenser according to claim 1 including a pouch adhered to the exterior of said surrounding sidewall, said pouch containing a plurality of tags.

4. A dispenser according to claim 1 wherein said first cord packing material is wound around a first spool and said second cord packing material is wound around a second spool.

5. A dispenser according to claim 4 including a spool support insert that includes at least one partition wherein each partition includes a slot.

6. A dispenser according to claim 5 including a spool axle extending through said first and second spools and said slot.

7. A dispenser according to claim 1 wherein said first quantity is less than said second quantity.

8. A dispenser according to claim 7 wherein said container includes indicia indicative of the ratio of said first quantity to said second quantity for use to pack a valve stem.

9. A dispenser according to claim 7 wherein said first quantity is one fourth of said second quantity.

10. A valve stem packing set, comprising:

a container including:

a base portion;

a surrounding sidewall extending from said base, said sidewall having first and second openings formed therethrough; and a plurality of flaps extending from said surrounding sidewall to form an openable lid for said container;

a first quantity of a first packing cord wound about a first spool and disposed in said container; and a second quantity of a second packing cord wound about a second spool and disposed in said container;

wherein the first quantity and the second quantity are determined by a ratio of the first racking cord to the second packing cord needed to pack a valve stem, and wherein said first packing cord is dispensable through said first opening and said second packing cord is dispensable through said second opening, and wherein said first spool of said first packing cord and second spool of said second packing cord is replaceable through said lid.

11. A valve stem packing set according to claim 10 including a first pull string attached to one end of said first packing cord and a second pull string attached to one end of said second packing cord, each said first and second pull string extending through a respective said first and second opening.

12. A valve stem packing set according to claim 10 including a pouch adhered to the exterior of said surrounding sidewall, said pouch containing a plurality of tags.

13. A valve stem packing set according to claim 10 wherein said first quantity is less than said second quantity.

14. A valve stem packing set according to claim 13 wherein said container includes indicia indicative of the ratio of said first quantity to said second quantity.

15. A valve stem packing set according to claim 13 wherein said first quantity is one fourth of said second quantity.

16. A valve stem packing set according to claim 10 including a spool support insert that includes a plurality of partitions wherein each partition includes a slot.

17. A valve stem packing set according to claim 16 including a spool axle extending through said first and second spools and said slots.

18. A spooled material container assembly, comprising:

a container comprising a base portion, a surrounding sidewall extending from said base portion, and a plurality of flaps extending from said surrounding sidewall, wherein said sidewall includes a plurality of frangible perforated star patterns formed therethrough;

a spool support insert disposed in the container, said insert including a plurality of partitions wherein each partition includes a slot;

a spool axle extending through said slots, said spool axle configured for supporting a plurality of spooled materials; and a spool rotationally supported on the spool axle, the spool containing a quantity of valve stem packing material.

19. A spooled material container assembly according to claim 18 wherein said container includes indicia of valve stem packing information indicative of the spooled materials to be contained in said container.

20. A spooled material container assembly according to claim 19 wherein said indicia is in the form of a graphic representative of the intended use of the spooled materials.

* * * * *